US006401990B1

(12) United States Patent
Walters et al.

(10) Patent No.: US 6,401,990 B1
(45) Date of Patent: Jun. 11, 2002

(54) FINGER-OPERABLE PUMP ACTUATOR WITH FINGER PAD

(75) Inventors: Peter J. Walters, Barrington, IL (US); David Moore, Camdenton, MO (US)

(73) Assignee: Seaquist Closures Foreign, Inc., Crystal Lake, IL (US)

( * ) Notice: Subject to any disclaimer, the term of this patent is extended or adjusted under 35 U.S.C. 154(b) by 0 days.

(21) Appl. No.: 09/597,929

(22) Filed: Jun. 19, 2000

(51) Int. Cl.[7] ..... B67D 5/00
(52) U.S. Cl. ..... 222/547; 222/526; 222/321.1
(58) Field of Search ..... 222/526, 531, 222/537, 544, 547, 559, 562

(56) References Cited

U.S. PATENT DOCUMENTS

| | | | | |
|---|---|---|---|---|
| 2,241,180 | A | | 5/1941 | Burke |
| 2,244,565 | A | | 6/1941 | Nast |
| 3,986,627 | A | | 10/1976 | Zapp |
| 3,990,598 | A | | 11/1976 | Zapp et al. |
| 4,335,068 | A | | 6/1982 | Hemery |
| 4,389,385 | A | | 6/1983 | Hendry |
| 4,416,602 | A | | 11/1983 | Neumeister |
| 4,440,820 | A | | 4/1984 | Shiho et al. |
| 4,458,819 | A | | 7/1984 | Geiger |
| 4,459,256 | A | | 7/1984 | Ziegler |
| 4,467,931 | A | | 8/1984 | Gach |
| 4,489,844 | A | | 12/1984 | Breskin |
| 4,500,218 | A | | 2/1985 | Nishikawa |
| 4,776,501 | A | | 10/1988 | Ostrosky |
| 4,789,326 | A | | 12/1988 | Sorensen |
| 4,808,106 | A | | 2/1989 | Holdt |
| 4,896,799 | A | * | 1/1990 | Giuffredi ..... 222/321.2 |
| 5,105,959 | A | | 4/1992 | Kinsley |
| 5,125,916 | A | | 6/1992 | Morita |
| 5,192,005 | A | | 3/1993 | Zimmerman |
| 5,205,424 | A | | 4/1993 | Gaspar |
| 5,236,107 | A | | 8/1993 | Spaanstra, Sr. |
| 5,273,177 | A | | 12/1993 | Campbell |
| 5,284,264 | A | | 2/1994 | Gross |
| 5,289,930 | A | | 3/1994 | Inouye |
| 5,294,385 | A | | 3/1994 | Hirota |
| 5,301,850 | A | * | 4/1994 | Gueret ..... 222/321.3 |
| 5,314,093 | A | | 5/1994 | Gross et al. |
| 5,328,058 | A | | 7/1994 | Leoncavallo et al. |
| 5,341,960 | A | | 8/1994 | Lay |
| 5,372,770 | A | | 12/1994 | Machida |
| 5,439,124 | A | | 8/1995 | Mock |
| 5,443,172 | A | | 8/1995 | Gabriele |
| 5,482,172 | A | | 1/1996 | Braddock |
| 5,503,303 | A | | 4/1996 | LeWare et al. |
| 5,629,029 | A | | 5/1997 | Souder et al. |
| 5,697,509 | A | | 12/1997 | Hayes |
| 5,700,500 | A | | 12/1997 | Wilhelm |
| 5,743,443 | A | | 4/1998 | Hins |
| 5,927,566 | A | | 7/1999 | Mueller |
| 6,029,866 | A | | 2/2000 | Wood et al. ..... 222/536 |

FOREIGN PATENT DOCUMENTS

| | | |
|---|---|---|
| EP | 0 570 276 A1 | 11/1993 |

* cited by examiner

*Primary Examiner*—J. Casimer Jacyna
(74) *Attorney, Agent, or Firm*—Wood, Phillips, Katz, Clark & Mortimer

(57) ABSTRACT

A finger-operable pump actuator is provided with a generally rigid body and a softer finger pad on top. The generally rigid body and the softer pad are preferably bi-injection molded together. The actuator may be bi-injection molded in a variety of aesthetically pleasing designs.

5 Claims, 6 Drawing Sheets

FINGER-OPERABLE PUMP ACTUATOR WITH FINGER PAD

CROSS REFERENCE TO RELATED APPLICATION(S)

Not applicable. cl STATEMENT REGARDING FEDERALLY SPONSORED RESEARCH OR DEVELOPMENT Not applicable.

REFERENCE TO A MICROFICHE APPENDIX

Not applicable.

TECHNICAL FIELD

This invention relates to a finger-operable pump for dispensing a product from a container. The invention is more particularly related to an actuator or button at the top of the pump that is depressed by the finger of the user so that the pump discharges the product through the actuator.

BACKGROUND OF THE INVENTION AND TECHNICAL PROBLEMS POSED BY THE PRIOR ART

A variety of packages that include a finger-operable dispensing pump on a container have been developed for household products, personal care products, and other products. It would be desirable to provide an improved pump actuator or button for use with such packages.

The actuator is typically designed to be depressed by the user pushing a finger down on a portion of a top surface of the actuator. See, for example, the actuator design disclosed in the U.S. Pat. No. 4,986,453. While such an actuator functions exceptionally well in the applications for which it is intended, it would be desirable to provide an improved actuator which has a means for delineating the region on the actuator which is to be pushed down by the user's finger.

Additionally, it would be advantageous if such an improved actuator could incorporate a finger pad against which the end of the user's finger could be pressed for forcing the actuator downwardly. In some applications, it may be desirable to provide such a finger pad made of material that is softer than the rest of the actuator, or which otherwise feels different and provides a different tactile sensation than the rest of the actuator.

Further, it would be desirable in some applications to provide an actuator with a finger pad that includes a color, texture, or material that is different from the color, texture, or material in the rest of the actuator. Preferably, such a finger pad could provide improved frictional engagement with a finger under wet conditions so as to minimize the tendency of the finger to slip off of the actuator.

Such an improved actuator should be susceptible of accommodating a variety of aesthetically pleasing designs adaptable for use on various dispensing pumps.

It would also be beneficial if such an improved dispensing pump actuator could readily accommodate its manufacture from a variety of different materials.

Further, it would be desirable if such an improved actuator could be provided with a design that would accommodate efficient, high quality, large volume manufacturing techniques with a reduced product reject rate.

Preferably, the improved actuator should also accommodate high speed manufacturing techniques that produce actuators having consistent structural and functional characteristics unit-to-unit with high reliability.

The present invention provides an improved dispensing pump actuator which can accommodate designs having the above-discussed benefits and features.

BRIEF SUMMARY OF THE INVENTION

The present invention provides an improved actuator for a finger-operable pump wherein the actuator is adapted to be disposed on the distal end of a pump discharge tube or stem. The improved actuator can be readily designed to provide an improved top surface (against which the user's finger presses to actuate the pump) which is softer than the rest of the actuator and which may provide increased friction to prevent slippage between the user's finger and the actuator. The top of the actuator can also be readily provided with a different color, as well as a different texture or material, than the rest of the actuator.

According to one aspect of the invention, the actuator includes a body for being mounted to the discharge tube. The actuator body comprises a first, generally rigid piece which is molded from a material and which defines an outwardly facing, force-receiving region. The actuator includes a second piece which is molded from a material (preferably a material that is different from the first material) onto the first, rigid piece force-receiving region and bonded to the first, rigid piece to define a finger pad against which a finger may be pressed to depress the actuator on the pump.

In a preferred embodiment, the first, rigid piece or body is molded from a thermoplastic material, such as polypropylene, and the second piece is molded from a rubber-based, thermoplastic elastomer which will feel softer compared to the polypropylene first piece or body. The finger pad may advantageously have a different color from the polypropylene first piece or body.

Further, it is presently contemplated that a preferred form of making the actuator includes bi-injection molding techniques, although other molding techniques could be employed, such as two-shot molding, multi-injection molding, or over-molding. In general, the actuator body is preferably made by injecting a first material, such as polypropylene, into the vacant cavity of an injection molding tool. During the first injection, part of the cavity is blocked to prevent the melt (e.g., the hot, flowable polypropylene) from filling a certain region of the cavity. The first material is then allowed to cool briefly. Subsequently, the blocking component or components are moved, or removed from the molding tool, to expose the additional region of the cavity volume. A second injection of material is then effected, typically with a material that is different from the first material. The second injection of the material fills the remaining, vacant region of the cavity and bonds to the substrate material of the first injection.

Numerous other advantages and features of the present invention will become readily apparent from the following detailed description of the invention, from the claims, and from the accompanying drawings.

BRIEF DESCRIPTION OF THE DRAWINGS

In the accompanying drawings forming part of the specification, in which like numerals are employed to designate like parts throughout the same.

DETAILED DESCRIPTION

While this invention is susceptible of embodiment in many different forms, this specification and the accompanying drawings disclose only some specific forms as examples of the invention. The invention is not intended to be limited to the embodiments so described, and the scope of the invention will be pointed out in the appended claims.

For ease of description, the actuator of this invention is described in a typical upright position, and terms such as upper, lower, horizontal, etc., are used with reference to this position. It will be understood, however, that the structure may be manufactured, stored, and used in orientations other than the one described.

Figure 1:
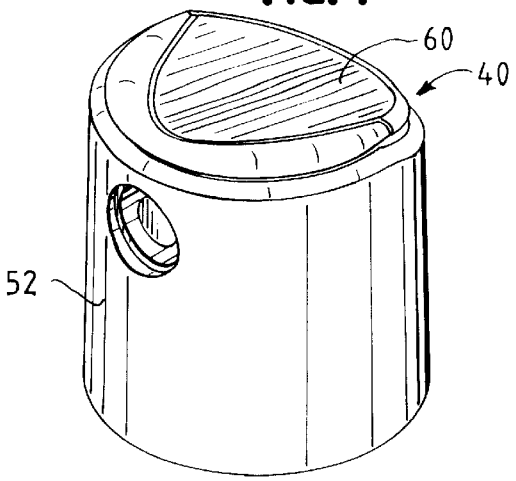
FIG. 1 is a side, perspective view of a first embodiment of an actuator for a finger-operable dispensing pump wherein the actuator is shown in an as-molded condition prior to installation of a mechanical break-up unit or insert spray nozzle.
Figure 2:
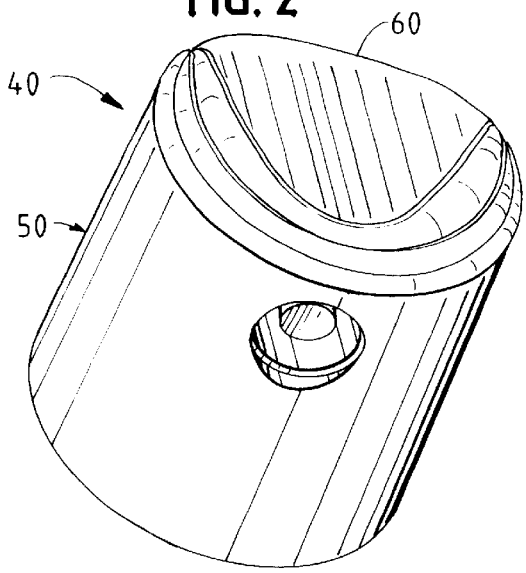
FIG. 2 is an enlarged, front perspective view thereof.
Figure 3:
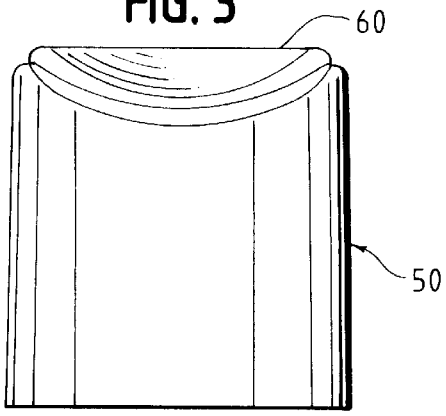
FIG. 3 is a rear elevational view thereof.
Figure 4:
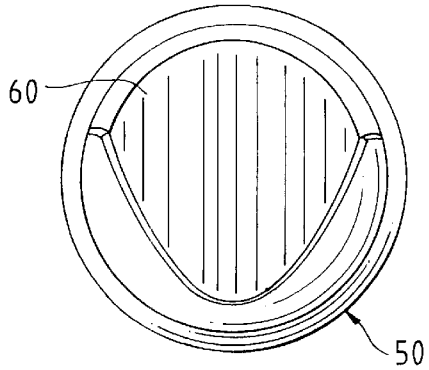
FIG. 4 is a top plan view thereof.
Figure 5:
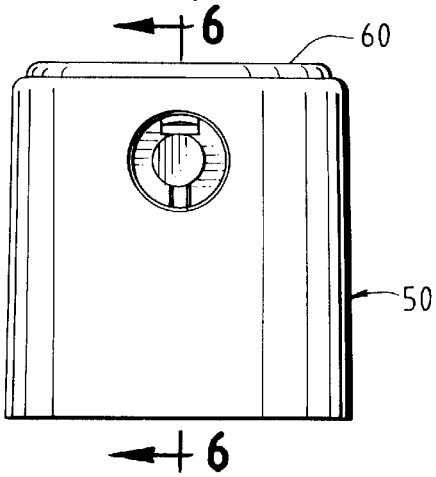
FIG. 5 is a front elevational view thereof.

A presently preferred, first embodiment of an actuator of the present invention is illustrated in FIGS. 1–6 and is designated generally in FIG. 1 by the reference numeral 40. The actuator 40 is adapted to be mounted on a stem or discharge tube 42 (FIG. 6) extending from a conventional or special finger-operable pump (not shown) which can be mounted in the opening of a container (not shown). The detailed design of the pump and container forms no part of the present invention.

Figure 6:
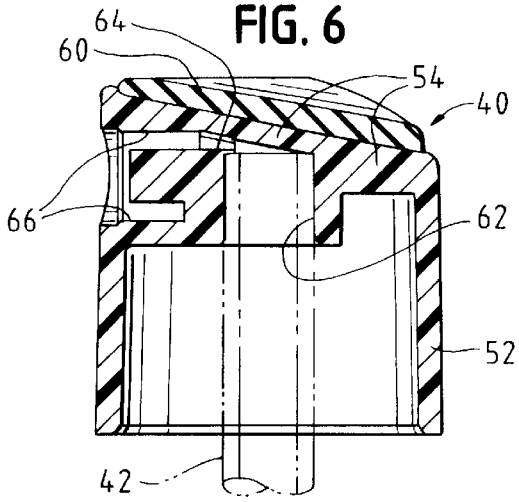
FIG. 6 is a cross-sectional view thereof taken generally along the plane 6—6 in FIG. 5.
Figure 7:
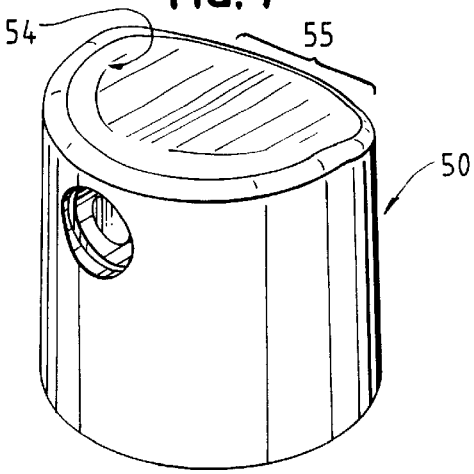
FIG. 7 is a perspective view thereof similar to FIG. 1, except that FIG. 7 illustrates an intermediate, partially completed form of the actuator molded from a first material prior to injection-molding a second material on the top of the intermediate, partially completed form to provide a finger pad.
Figure 8:
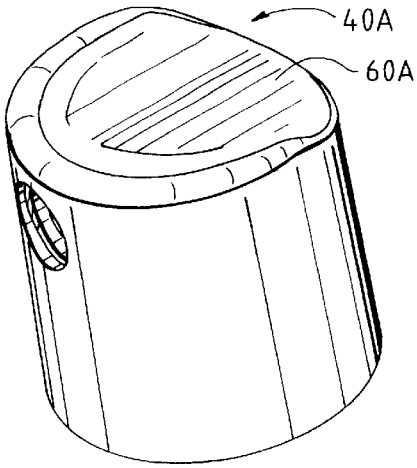
FIG. 8 is a side, perspective view of a second embodiment of an actuator for a finger-operable dispensing pump in an as-molded condition prior to installation of a mechanical break-up unit or insert spray nozzle.
Figure 9:
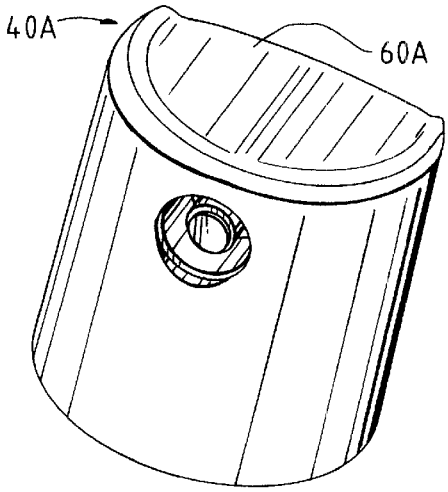
FIG. 9 is an enlarged, front perspective view thereof.
Figure 10:
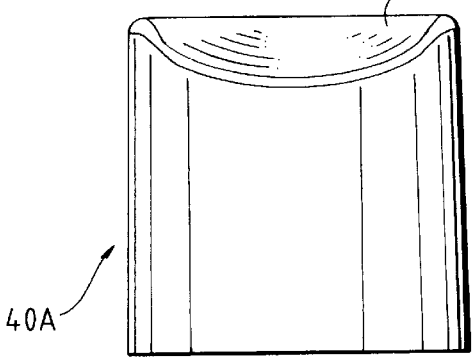
FIG. 10 is a rear elevational view thereof.
Figure 11:
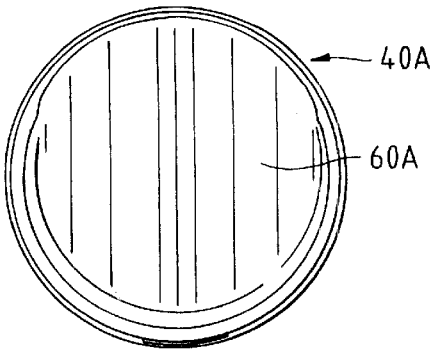
FIG. 11 is a top plan view thereof.
Figure 12:
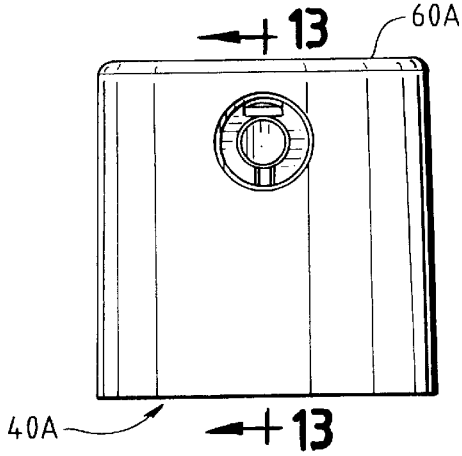
FIG. 12 is a front elevational view thereof.
Figure 13:
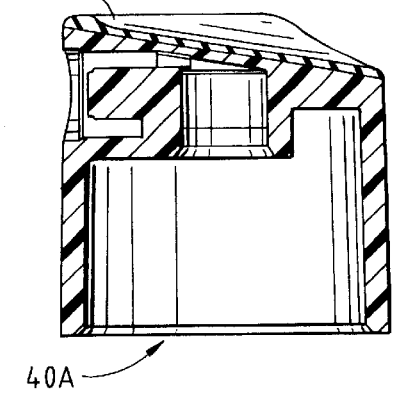
FIG. 13 is a cross-sectional view thereof taken generally along the plane 13—13 in FIG. 12.
Figure 14:
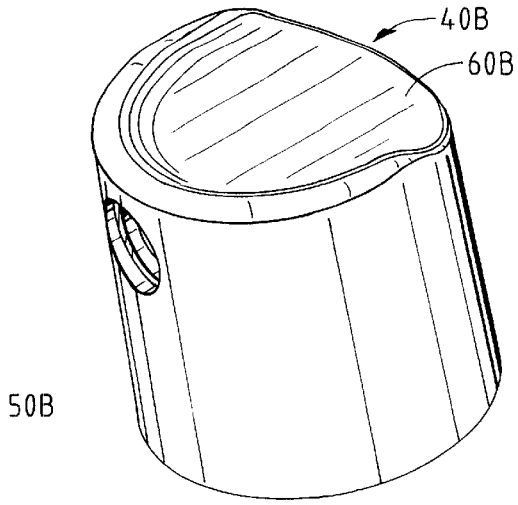
FIG. 14 is a side, perspective view of a third embodiment of an actuator for a finger-operable dispensing pump in an as-molded condition prior to installation of a mechanical break-up unit or insert spray nozzle.
Figure 15:
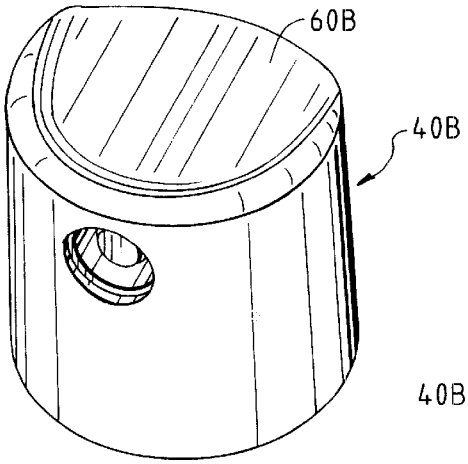
FIG. 15 is an enlarged, front perspective view thereof.
Figure 16:
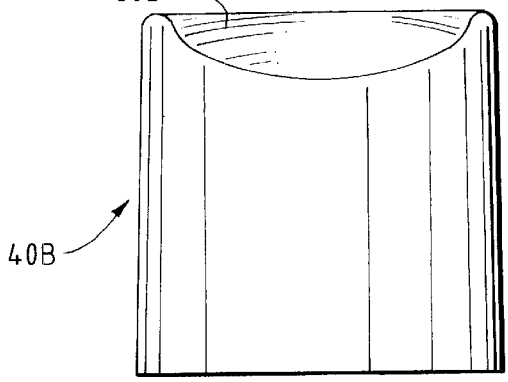
FIG. 16 is a rear elevational view thereof.
Figure 17:
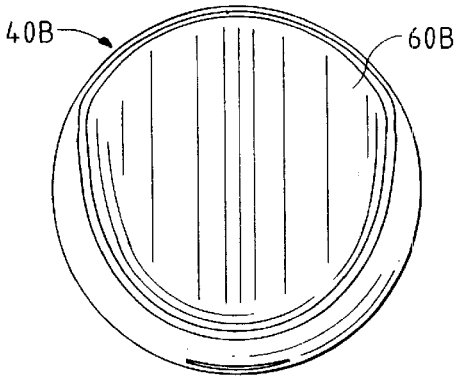
FIG. 17 is a top plan view thereof.
Figure 18:
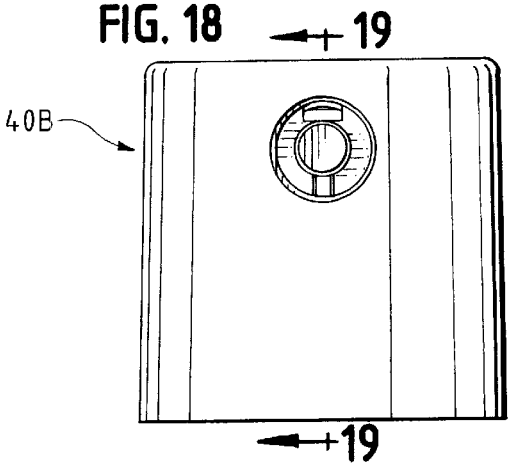
FIG. 18 is a front elevational view thereof.
Figure 19:
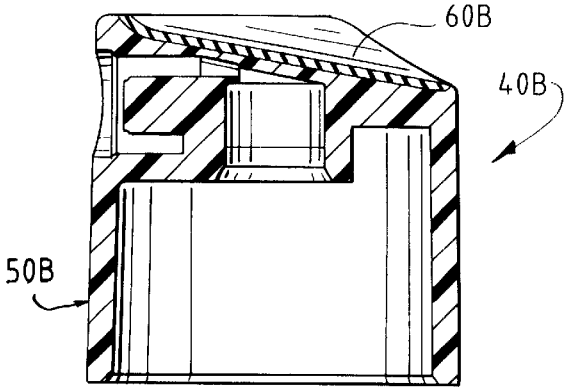
FIG. 19 is a cross-sectional view thereof taken generally along the plane 19—19 in FIG. 18.
Figure 20:
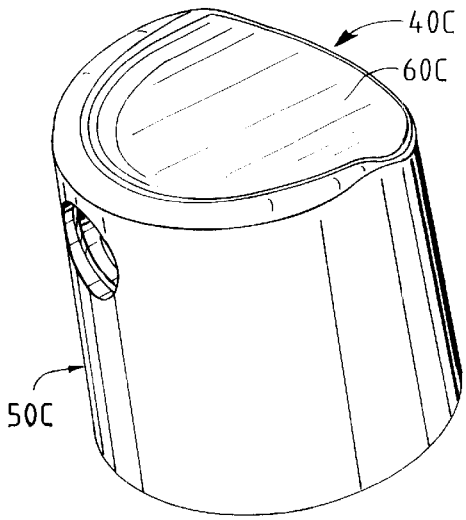
FIG. 20 is a side, perspective view of a fourth embodiment of an actuator for a finger-operable dispensing pump in an as-molded condition prior to installation of a mechanical break-up unit or insert spray nozzle.
Figure 21:
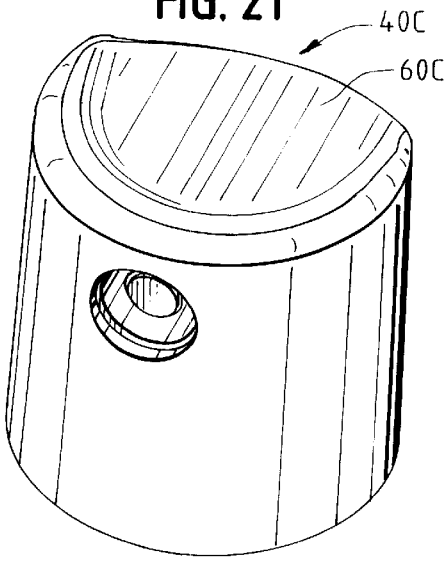
FIG. 21 is an enlarged, front perspective view thereof.
Figure 22:
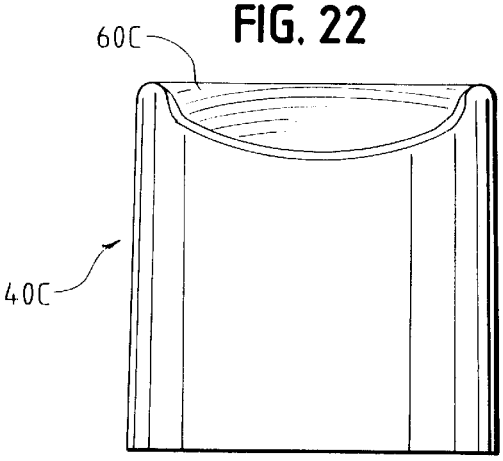
FIG. 22 is a rear elevational view thereof.
Figure 23:
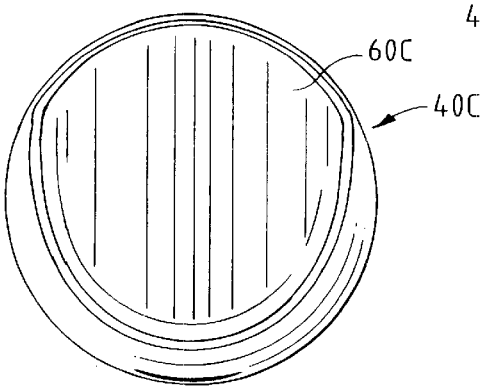
FIG. 23 is a top plan view thereof.
Figure 24:
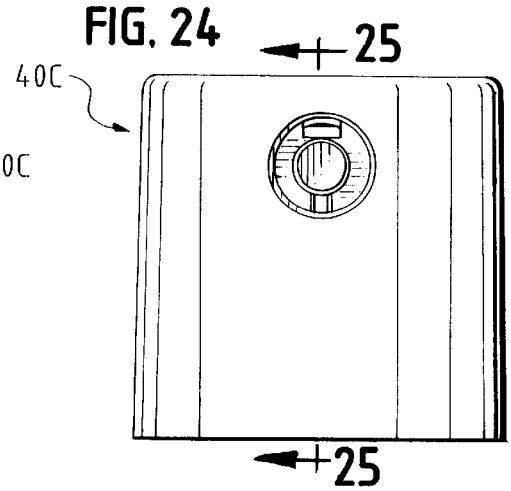
FIG. 24 is a front elevational view thereof.
Figure 25:
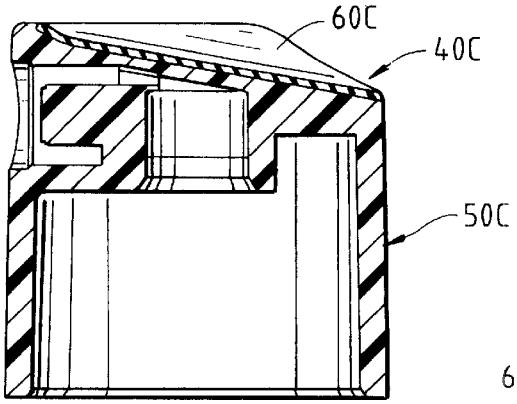
FIG. 25 is a cross-sectional view thereof taken generally along the plane 25—25 in FIG. 24.
Figure 26:
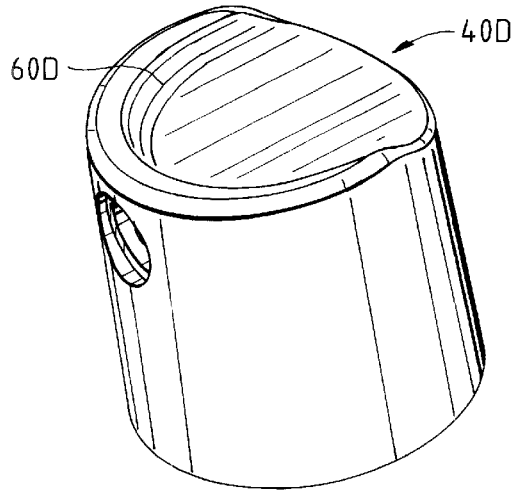
FIG. 26 is a side, perspective view of a fifth embodiment of an actuator for a finger-operable dispensing pump in an as-molded condition prior to installation of a mechanical break-up unit or insert spray nozzle.
Figure 27:
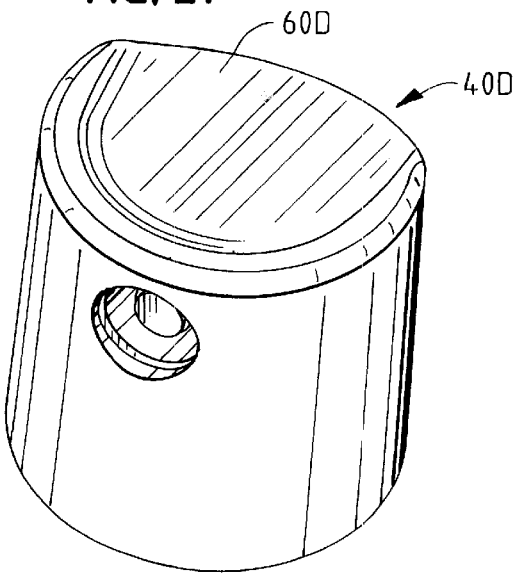
FIG. 27 is an enlarged, front perspective view thereof.
Figure 28:
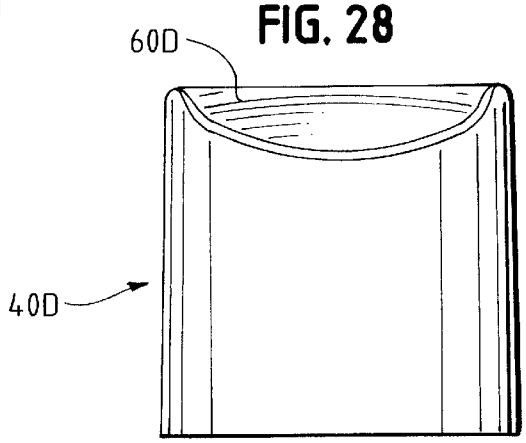
FIG. 28 is a rear elevational view thereof.
Figure 29:
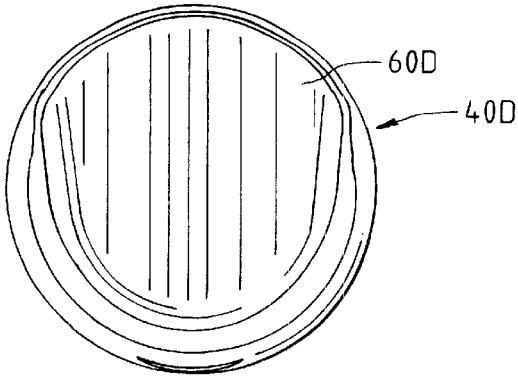
FIG. 29 is a top plan view thereof.
Figure 30:
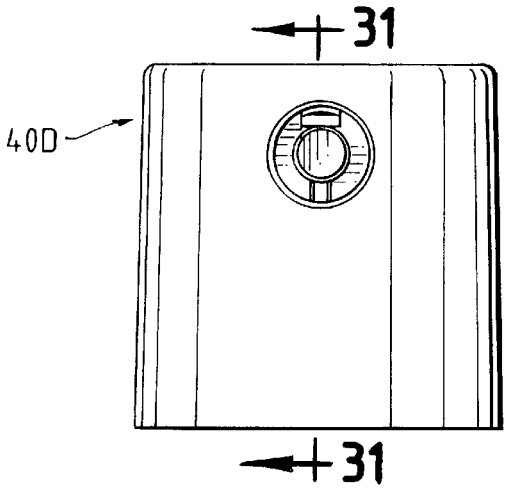
FIG. 30 is a front elevational view thereof.
Figure 31:
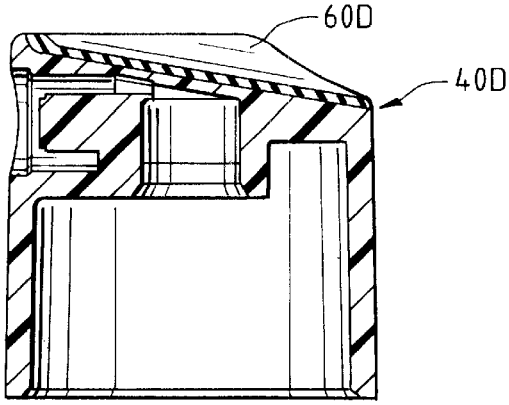
FIG. 31 is a cross-sectional view thereof taken generally along the plane 31—31 in FIG. 30.

The actuator 40 includes a body 50 (FIG. 7) in the form of a first, generally rigid piece having a peripheral skirt 52 and a top deck defining a force-receiving region 54 (FIG. 7) on which a finger pad 60 (FIGS. 1–6) is subsequently disposed. The upwardly facing, top surface of the deck 54 has a central concave region 55 which appears recessed relative to a peripheral wall around the front and both sides, but not the back. As shown in FIG. 6, the underside of the deck 54 defines a bore 62 for receiving the upper, distal end of the pump discharge tube or stem 42. The deck 54 also defines a discharge passage 64 extending from the bore 62 to an annular cavity 66 for receiving a conventional or special mechanical break-up unit ("MBU"), also known as an insert spray nozzle (not shown). The nozzle or MBU helps the liquid pumped through the actuator 40 to be discharged from the actuator in the form of an atomized spray or mist. One such insert spray nozzle that may be used is described with reference to element 92 in FIG. 1 of the U.S. Pat. No. 4,986,453, the disclosure of which is incorporated herein by reference thereto to the extent not inconsistent herewith. The insert spray nozzle forms no part of the present invention.

The finger pad 60, in the preferred embodiment illustrated in FIGS. 1–6, is molded from a rubber-based, thermoplastic elastomer on the force-receiving region 54 of the deck 54 of the actuator body 50. The body 50 of the actuator 40 is preferably molded from a thermoplastic material such as polypropylene which is generally substantially rigid after it has been molded. Thus, the finger pad 60, if it is molded from a rubber-based, thermoplastic elastomer, will feel softer compared to the actuator body 50. This will provide a pleasant tactile sensation for the user and can further function to provide greater frictional engagement between the pad 60 and the user's finger. This may be especially helpful when the actuator 40 is incorporated in a pump on a container for a product which is typically used in a shower or bathroom where the user's hands may be wet.

In a preferred form of the actuator 40, the finger pad material is a different color than the color of the material used to form the body 50 of the actuator 40. This will more readily distinguish the finger pad region from the rest of the actuator 40 and will provide the user with a readily apparent indication that the finger pad region is the region which should be pressed to actuate the pump.

In the presently preferred form of the actuator 40, the actuator is formed by a molding process such as bi-injection molding, two-shot molding, multi-injection molding, or over-molding. Descriptions of multi-shot, multi-material injection molding techniques are set forth in "Multi-Material Injection Saves Time, While Cutting Costs," MODERN PLASTICS, Mar. 19, 1994 (author: Peter Mapleston), in "Molding Many Parts Into One," Product Design and Development, Dec. 19, 1995, page 16 (author: Jay Rosenberg), and in U.S. Pat. No. 5,439,124. Also see the European Patent Publication No. 0 570 276 A1 which discloses how an internal mold element 12 can be repositioned to accommodate the molding of a second material into a ring 8 against a closure body previously molded from a first material.

Preferably, a bi-injection molding process is employed in the manufacture of the actuator 40 of the present invention. Specifically, the actuator body 50 (which does not include the finger pad 60 per se) is molded as a first piece from a first material, such polypropylene, in a cavity of a mold assembly or tool. Part of the cavity is blocked with a removable or movable blocking member to prevent the hot, flowable polypropylene from filling the portion of the cavity where the finger pad 60 will be subsequently located. The first material is then allowed to cool briefly.

Subsequently, the blocking member is moved or removed so as to expose the additional region of the mold cavity. The second material, such as a rubber-based, thermoplastic elastomer, is injected into the remaining vacant region of the cavity. This is allowed to cool to become attached or bonded to the first piece (i.e., the actuator body 50) with a weld defined by the interface solidification of melted portions of the second and/or first materials. The completed molded structure may then be removed from the mold assembly. Subsequently, an insert spray nozzle or MBU can be installed in the actuator 40, and the actuator can be mounted on the discharge tube or stem 42 of a pump.

Although the actuator is molded from a first injection of material to form the body 50, and is molded from a subsequent (second) injection of material to form the finger pad 60, the material employed in both the first injection and the second injection could be the same material. Typically, however, the finger pad 60 would contrast with the underlying portion of the actuator body 50. This contrast may be effected by simply providing the actuator pad 60 with a different color (even though the pad 60 and underlying portion of the actuator body 50 could be molded from the same material).

Alternatively, however, the contrast between the finger pad 60 and the underlying portion of the actuator body 50 could be provided by using two different materials which may have the same color but which have different surface textures. Various textures may be molded into the upper surface of the finger pad 60. Additionally, the finger pad 60 may be provided with indicia molded directly into the finger pad material, and such indicia may include symbols, words, logos, etc.

The present invention also contemplates that a third material, or even more materials, may be molded with multi-injection processes to form a multi-material actuator. Alternatively, one material may be molded in three or more separate injections to provide a multi-injection molded actuator. Where the same material is employed in two or more injections, the material may have different colors for each of the different injections.

FIGS. 10–13 illustrate a second embodiment of an actuator 40A. The structure of the actuator 40A is similar to the first embodiment of the actuator 40 described above with reference to FIGS. 1–6 except that the second embodiment actuator 40A has a different top configuration with respect to the shape of the finger pad 60A. The finger pad 60A extends substantially over the entire top surface of the actuator body and has a much thinner central region than does the pad 60 in the first embodiment.

FIGS. 14–19 illustrate a third embodiment of an actuator 40B. The structure of the actuator 40B is similar to the first embodiment of the actuator 40 described above with reference to FIGS. 1–6 except that the second embodiment actuator has a body 50B with an arcuate top surface, and the overlying finger pad 60B has an arcuate top surface that does not project upwardly beyond the upper edge of the body 50B. Further, the second embodiment pad 60B has a much thinner central region than does the pad 60 in the first embodiment. The vertical rear edge of the pad 60B is covered by the adjacent portion of the body 50B.

FIGS. 20–25 illustrate a fourth embodiment of an actuator 40C. The structure of the actuator 40C is similar to the third embodiment of the actuator 40B described above with reference to FIGS. 14–19 except that the fourth embodiment actuator 40C has a slightly different top configuration with respect to the shape of the body 50C and finger pad 60C. The finger pad 60C rear edge extends to the rear edge of the actuator body 50C, and the rear edge surface of the pad 60C is visible.

FIGS. 26–31 illustrate a fifth embodiment of an actuator 40D. The structure of the actuator 40D is similar to the fourth embodiment of the actuator 40C described above with reference to FIGS. 20–25 except that the front edge of the finger pad 60D in the fifth embodiment actuator 40D has a greater peripheral width.

The five embodiments of the actuator are examples of different, aesthetically pleasing designs which can be incorporated in the present invention. It will be appreciated that other aesthetically pleasing shapes and configurations may be provided in the actuator body and in the finger pad.

It will be readily observed from the foregoing detailed description of the invention and from the illustrations thereof that numerous other variations and modifications may be effected without departing from the true spirit and scope of the novel concepts or principles of this invention.

What is claimed is:

1. An actuator for a finger-operable pump that has a discharge tube and that is mounted to a dispensing end of a container from which product can be pumped without assistance from any other pressurizing device, said actuator accommodating vertical reciprocation relative to said container and comprising:

a body including a structure to mount said actuator on the top end of said discharge tube to prevent pivoting of said body relative to said tube, said body comprising a first, generally rigid piece which is molded from a material defining (1) a discharge passage for communicating with said discharge tube, and (2) an outwardly facing, force-receiving region; and a second piece which is bi-injection molded in situ from a material onto said first, rigid piece force-receiving region and bonded to said first, rigid piece by interface solidification of melted portions of material to define a finger pad against which a finger may be pressed to depress said actuator for translating said actuator and discharge tube downwardly relative to said container.

2. The dispensing structure in accordance with claim 1 in which said first, rigid piece is molded from a thermoplastic material; and said second piece is molded from a rubber-based, thermoplastic elastomer.

3. The actuator in accordance with claim 1 in which said first, rigid piece and said second piece are molded from the same material.

4. The actuator in accordance with claim 1 in which said second piece has a color which differs from the color of said first, rigid piece.

5. The actuator in accordance with claim 1 in which said second piece includes surface contours molded into the surface of said second piece.

* * * * *